US011408281B2

(12) United States Patent
Lu et al.

(10) Patent No.: US 11,408,281 B2
(45) Date of Patent: Aug. 9, 2022

(54) METHOD FOR DETERMINING SAND PUMPING PARAMETERS BASED ON WIDTH DISTRIBUTION OF FRACTURE

(71) Applicant: SOUTHWEST PETROLEUM UNIVERSITY, Chengdu (CN)

(72) Inventors: Qianli Lu, Chengdu (CN); Jianchun Guo, Chengdu (CN); Zhuang Liu, Chengdu (CN); Le He, Chengdu (CN); Songgen He, Chengdu (CN); Yong Ren, Chengdu (CN); Ji Zeng, Chengdu (CN); Shouyi Wang, Chengdu (CN); Shan Ren, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 17/540,260

(22) Filed: Dec. 2, 2021

(65) Prior Publication Data

US 2022/0090495 A1 Mar. 24, 2022

(30) Foreign Application Priority Data

Jun. 10, 2021 (CN) ..... 202110648394.1

(51) Int. Cl.
*E21B 49/00* (2006.01)
*E21B 43/267* (2006.01)

(52) U.S. Cl.
CPC ..... *E21B 49/00* (2013.01); *E21B 43/267* (2013.01); *E21B 2200/20* (2020.05)

(58) Field of Classification Search
None
See application file for complete search history.

(56) References Cited

U.S. PATENT DOCUMENTS

2016/0122630 A1* 5/2016 Wehunt ..... E21B 43/267 507/203
2017/0121594 A1* 5/2017 Baleno ..... E21B 43/04

OTHER PUBLICATIONS

"Research on the optimal design of fracturing of Carboniferous volcanic rocks in the Che 21 well area", Cheng Hao, "China Excellent Doctoral DisseitaLion Full-text Database (Master) Engineering Science and Technology Series I", pp. B019-3038.

* cited by examiner

*Primary Examiner* — Roy Y Yi

(57) ABSTRACT

A method for determining sand pumping parameters based on width distribution of fracture, including: acquire basic parameters of a target reservoir, simulate a propagation of the fracture, and obtain a propagation pattern and width distribution of the fracture; determine a maximum proppant particle size for entering the fracture at all width levels according to statistical results of the width distribution of the fracture; determine a multi-size combination of proppants according to a mapping table for particle size vs mesh of proppants, and determine an initial ratio of the proppant with each particle size; conduct a numerical simulation of proppant transportation in the fracture to determine a retention ratio of the proppants with each particle size; correct the initial ratio of the proppants with each particle size; calculate an amount of the proppants with each particle size according to the final ratio and the sand pumping intensity and fracturing interval length.

5 Claims, 2 Drawing Sheets

METHOD FOR DETERMINING SAND PUMPING PARAMETERS BASED ON WIDTH DISTRIBUTION OF FRACTURE

BACKGROUND OF THE APPLICATION

Technical Filed

The present invention relates to the technical field of oil and gas engineering, in particular to a method and a test system for determining sand pumping parameters based on a width distribution of a fracture.

Description of Related Art

The staged and clustered volume stimulation of horizontal wells has become a key technology for effective development of unconventional oil and gas. In the field construction process, the fractures are forced to turn their direction under the action of multi-cluster perforation and intra-cluster stress, and connected to the natural fractures through hydraulic fractures, forming a fracture network with multiple widths. The fracturing fluid carries proppant into the fracture to effectively support the fracture channel to create artificial permeability, greatly improving the production of a single well.

In order to realize the flow conductivity required for complex fractures with multiple widths, engineers considered utilizing proppants with a combination of multiple particle sizes to effectively support fractures at all width levels. However, it is difficult to actually realize the flow conductivity required for complex fractures with multiple widths using the existing sand pumping technologies. On the one hand, the ratio of proppant with each particle size is determined frequently depending on empirical design and cannot be optimized according to different reservoir geological engineering conditions, and the particle size of the agent cannot match with the actual fracture width, thus some fractures cannot be effectively supported. On the other hand, the proppant retention in the main fractures during proppant transportation in complex fractures has not been considered in the existing methods, resulting in a small amount of proppant used in the secondary fractures.

SUMMARY OF THE INVENTION

In order to solve the above problems, the present invention aims to provide a method and a test system for determining sand pumping parameters based on a width distribution of a fracture which is more suitable for complex fractures.

The technical solution of the present invention is as follows:

A method for determining sand pumping parameters based on a width distribution of a fracture comprises the following steps:

Step 1: using a plurality of sensors to acquire basic parameters of a target reservoir, using a test system to simulate a propagation of the fracture, and using the test system to obtain a propagation pattern and the width distribution of the fracture;

Step 2: using the test system to determine a maximum proppant particle size for entering the fracture at all width levels according to statistical results of the width distribution of the fracture;

Step 3: using the test system to determine a multi-size combination of proppants according to the Particle Size vs Mesh of Common Proppants, and determining an initial ratio of the proppant with each particle size based on the ratio of each fracture width;

Step 4: using the test system to conduct a numerical simulation of proppant transportation in the fracture to determine a retention ratio of the proppants with each particle size;

Step 5: using the test system to correct the initial ratio of the proppants with each particle size according to the retention ratio and obtain a final ratio of the proppants with each particle size;

Step 6: using the test system to calculate an amount of the proppants with each particle size according to the final ratio and a sand pumping intensity and a fracturing interval length of the target reservoir, and using a display screen of the test system to display results of the amount of the proppants with each particle size and the propagation pattern of the fracture.

Preferably, the basic parameters include geological parameters and engineering parameters; the geological parameters include crustal stress, natural fracture distribution, and rock mechanics parameters; the engineering parameters include perforation parameter, single-stage sand pumping intensity, and construction displacement.

Preferably, in Step 1, a damage-field-evolution-based fracture propagation model is used to simulate the propagation of complex fracture.

Preferably, the damage-field-evolution-based fracture propagation model comprises:

1) Evolution Equation of Fracture Damage Field:

$$\eta\frac{\partial\varphi}{\partial t} = [2(1-\varphi)(\lambda S(\varepsilon_x+\varepsilon_y)/2 + GS(\varepsilon_x) + GS(\varepsilon_y)) - g_f\varphi/l + g_f l\Delta\varphi] \tag{1}$$

$$\varphi(d) = e^{\frac{-|d|}{l}}$$

$$S(d) = (|d|+d)^2/4;$$

where, $\eta$ is the damping coefficient, in MPa·s; $\varphi$ is the damage field function, dimensionless; t is the time, in s; $\lambda$ is the Lamé first coefficient, in Pa; S is the ramp function, dimensionless; $\varepsilon_i$ is the principal strain in the i direction (i=x,y; x,y is the direction of the particle displacement), dimensionless; G is the Lamé second coefficient, in Pa; $g_f$ is the fracture toughness, in Pa; l is the length measurement parameter, dimensionless; $\Delta\varphi$ is the variation of damage field, dimensionless; d is the formal parameter, dimensionless.

2) Matrix Stress Field Equation:

$$\rho\frac{\partial^2 u_i}{\partial t^2} = Gu_{i,jj} + \frac{G}{1-2\upsilon}u_{j,ji} + \eta\nabla^2 v_i \tag{2}$$

$$u_{i,jj} = \frac{\partial^2 u_i}{x^2} + \frac{\partial^2 u_i}{y^2} \quad i = x, y$$

$$u_{j,ji} = \frac{\partial^2 u_x}{\partial x\partial x} + \frac{\partial^2 u_y}{\partial y\partial x};$$

$$\sigma = \frac{2G\upsilon}{1-2\upsilon}(u_{i,i}+u_{j,j}) + G(u_{i,j}+u_{j,i}) \tag{3}$$

$$u_{i,i} = \frac{\partial u_i}{\partial i};\ u_{j,j} = \frac{\partial u_j}{\partial j};\ u_{i,j} = \frac{\partial u_i}{\partial j};\ u_{j,i} = \frac{\partial u_j}{\partial i}$$

$$i = x, y \quad j = x, y;$$

where, $\rho$ is the density of the rock mass, in kg/m$^3$; $u_i$ is the displacement component, in m; $u_{i,jj}$, $u_{j,ji}$, $u_{i,i}$, $u_{j,j}$, $u_{i,j}$ and $u_{j,i}$ are the tensorial form of displacement increments, with j meaning the j direction (j=x, y, z), dimensionless; ν is the Poisson's ratio of the rock, dimensionless; ∇ is the Hamiltonian operator, dimensionless; $v_i$ is the velocity of the particle in the i direction, in m/s; σ is the stress of the particle, in Pa.

3) Fracture Flow Equation:

$$\frac{w^3}{12\,\mu L}\frac{\partial^2 p}{\partial x^2}+\frac{w^3}{12\,\mu L}\frac{\partial^2 p}{\partial y^2}+\frac{q_s}{\rho}=\frac{wC}{L}\frac{\partial p}{\partial t}; \tag{4}$$

where, w is the fracture width, in m; μ is the fluid viscosity, in Pa·s; L is the unit length, in m; p is the fluid pressure, in Pa; $q_s$ is the grid source, in kg/(m$^3$·s); C is the rock compressibility, in Pa$^{-1}$.

4) Matrix Flow Equation:

$$\frac{\partial^2 p}{\partial x^2}+\frac{\partial^2 p}{\partial y^2}+\frac{\mu}{k}\frac{q_s}{\rho}=\frac{\phi C\mu}{k}\frac{\partial p}{\partial t}; \tag{5}$$

where, k is the rock permeability, in m$^2$; ϕ is the rock porosity, in %.

Preferably, in Step 2, the maximum proppant particle size for entering the fracture at all width levels is determined by the following equation:

$$d_{max}=w/7 \tag{6}$$

where, $d_{max}$ is the maximum proppant particle size for entering the fracture, in m; if the minimum width of the fracture at a certain width level is 0 m, w is the median width of the fracture at that width level or the width of the fracture with the highest ratio; if the minimum width of the fracture at a certain width level is not 0 m, w is the minimum width of the fracture.

Preferably, in Step 3, when determining the initial ratio of proppant with each particle size, the proppant of the maximum particle size is selected to enter the fracture at a certain width level if proppants of multiple particle sizes can enter the fracture.

Preferably, in Step 5, the following equation is employed to Using the test system to correct the initial ratio of the proppants with each particle size:

$$n_c=n(1+\alpha) \tag{7}$$

where, $n_c$ is the corrected ratio of proppant, dimensionless; n is the initial ratio of proppant, dimensionless; α is the retention ratio of proppant, dimensionless.

Then, obtain a final ratio of the proppants with each particle size by removing the proppants with greater particle size after the sum of the ratios is over 100% based on a criterion of satisfying the ratios of proppants with smaller particle sizes in priority.

A test system for determining sand pumping parameters based on a width distribution of a fracture is provided, which includes a plurality of sensors, a processor and a display screen.

The plurality of sensors are configured to acquire basic parameters of a target reservoir.

The processor is configured to: simulate a propagation of the fracture, and obtain a propagation pattern and the width distribution of the fracture; determine a maximum proppant particle size for entering the fracture at all width levels according to statistical results of the width distribution of the fracture; determine a multi-size combination of proppants according to a mapping table for particle size vs mesh of the proppants, and determine an initial ratio of the proppants with each particle size based on a ratio of each fracture width; conduct a numerical simulation of proppant transportation in the fracture to determine a retention ratio of the proppants with each particle size; correct the initial ratio of the proppants with each particle size according to the retention ratio and obtaining a final ratio of the proppants with each particle size; and calculate an amount of the proppants with each particle size according to the final ratio and a sand pumping intensity and a fracturing interval length of the target reservoir.

The display screen is configured to display results of the amount of the proppants with each particle size and the propagation pattern of the fracture.

The present invention has the following beneficial effects:

1. The present invention is highly targeted. Under given reservoir geological engineering conditions, the present invention can design the sand pumping parameters in a targeted manner, and provide an individualized design of the scheme;

2. The present invention is highly applicable. Based on the whole-process quantitative calculation, specific sand pumping parameters can be worked out for different fracture widths, with a significance for guiding the actual engineering design;

3. The present invention is highly efficient, with low investment. There is no need to conduct an experiment, and the design calculation can be completed within 2 hours.

BRIEF DESCRIPTION OF DRAWINGS

In order to explain the embodiments of the present invention or the technical solutions in the prior art more clearly, the following will make a brief introduction to the drawings needed in the description of the embodiments or the prior arts. Obviously, the drawings in the following description are merely some embodiments of the present invention. For those of ordinary skill in the art, other drawings can be obtained based on these drawings without any creative effort.

DETAILED DESCRIPTION

Figure 1:
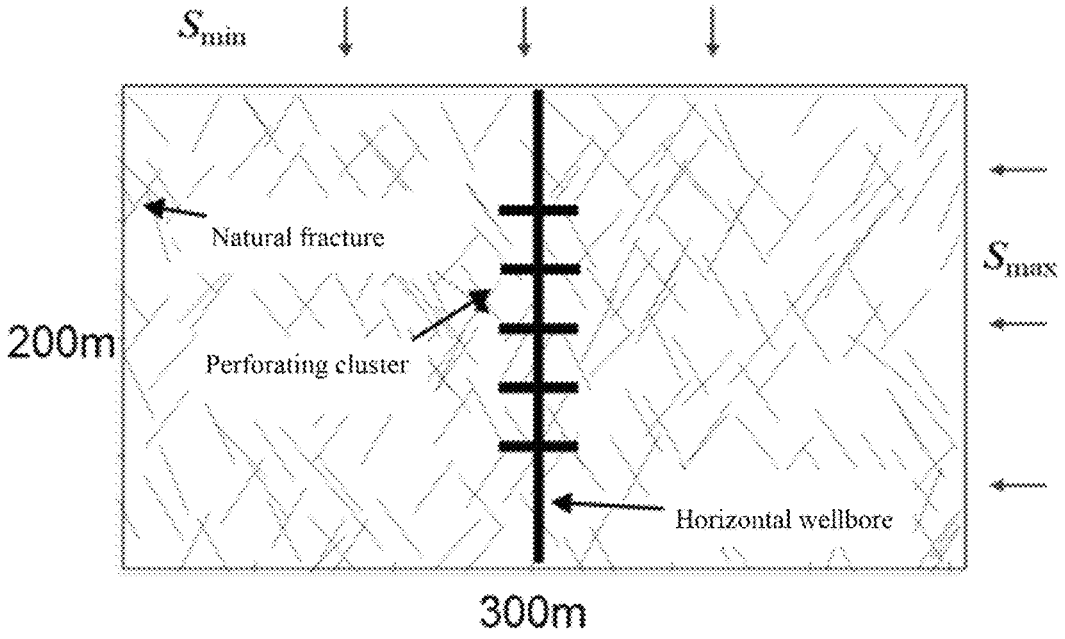
FIG. 1 is a schematic diagram of a geologic model for reservoir fracturing according to an embodiment of the present invention.

The present invention is further described with reference to the drawings and embodiments. It should be noted that the embodiments in this application and the technical features in the embodiments can be combined with each other without conflict. It is to be noted that, unless otherwise specified, all technical and scientific terms herein have the same meaning as commonly understood by those of ordinary skill in the art to which this application belongs. "Include" or "comprise" and other similar words used in the present disclosure mean that the component or object before the word covers the components or objects listed after the word and its equivalents, but do not exclude other components or objects.

The present invention provides a method for determining sand pumping parameters based on a width distribution of a fracture, comprising the following steps: Step 1: Using sensors to acquire basic parameters of a target reservoir, using a test system to simulate a propagation of the fracture, and using the test system to obtain a propagation pattern and the width distribution of the fracture.

In a specific embodiment, the basic parameters include geological parameters and engineering parameters; the geological parameters include crustal stress, natural fracture distribution, and rock mechanics parameters; the engineering parameters include perforation parameter, single-stage sand pumping intensity, and construction displacement.

In a specific embodiment, a damage-field-evolution-based fracture propagation model is employed to simulate the propagation of complex fracture, and the damage-field-evolution-based fracture propagation model includes:

1) Evolution Equation of Fracture Damage Field:

$$\eta\frac{\partial\varphi}{\partial t} = [2(1-\varphi)(\lambda S(\varepsilon_x+\varepsilon_y)/2 + GS(\varepsilon_x) + GS(\varepsilon_y)) - g_f\varphi/l + g_f l\Delta\varphi] \quad (1)$$

$$\varphi(d) = e^{\frac{-|d|}{l}}$$

$$S(d) = (|d|+d)^2/4;$$

where, $\eta$ is the damping coefficient, in MPa·s; $\varphi$ is the damage field function, dimensionless; t is the time, in s; $\lambda$ is the Lamé first coefficient, in Pa; S is the ramp function, dimensionless; $\varepsilon_i$ is the principal strain in the i direction (i=x,y; x,y is the direction of the particle displacement), dimensionless; G is the Lamé second coefficient, in Pa; $g_f$ is the fracture toughness, in Pa; l is the length measurement parameter, dimensionless; $\Delta\varphi$ is the variation of damage field, dimensionless; d is the formal parameter, dimensionless.

2) Matrix Stress Field Equation:

$$\rho\frac{\partial^2 u_i}{\partial t^2} = Gu_{i,jj} + \frac{G}{1-2\upsilon}u_{j,ji} + \eta\nabla^2 v_i \quad (2)$$

$$u_{i,jj} = \frac{\partial^2 u_i}{x^2} + \frac{\partial^2 u_i}{y^2} \quad i = x, y$$

$$u_{j,ji} = \frac{\partial^2 u_x}{\partial x\partial x} + \frac{\partial^2 u_y}{\partial y\partial x};$$

$$\sigma = \frac{2G\upsilon}{1-2\upsilon}(u_{i,i}+u_{j,j}) + G(u_{i,j}+u_{j,i}) \quad (3)$$

$$u_{i,i} = \frac{\partial u_i}{\partial i};\ u_{j,j} = \frac{\partial u_j}{\partial j};\ u_{i,j} = \frac{\partial u_i}{\partial j};\ u_{j,i} = \frac{\partial u_j}{\partial i}$$

$$i = x, y\ \ j = x, y;$$

where, $\rho$ is the density of the rock mass, in kg/m$^3$; $u_i$ is the displacement component, in m; $u_{i,jj}$, $u_{j,ji}$, $u_{i,i}$, $u_{j,j}$, $u_{i,j}$ and $u_{j,i}$ are the tensorial form of displacement increments, with j meaning the j direction (j=x, y, z), dimensionless; $\nu$ is the Poisson's ratio of the rock, dimensionless; $\nabla$ is the Hamiltonian operator, dimensionless; $v_i$ is the velocity of the particle in the i direction, in m/s; $\sigma$ is the stress of the particle, in Pa;

3) Fracture Flow Equation:

$$\frac{w^3}{12\ \mu L}\frac{\partial^2 p}{\partial x^2} + \frac{w^3}{12\ \mu L}\frac{\partial^2 p}{\partial y^2} + \frac{q_s}{\rho} = \frac{wC}{L}\frac{\partial p}{\partial t}; \quad (4)$$

where, w is the fracture width, in m; $\mu$ is the fluid viscosity, in Pa·s; L is the unit length, in m; p is the fluid pressure, in Pa; $q_s$ is the grid source, in kg/(m$^3$·s); C is the rock compressibility, in Pa$^{-1}$;

4) Matrix Flow Equation:

$$\frac{\partial^2 p}{\partial x^2} + \frac{\partial^2 p}{\partial y^2} + \frac{\mu}{k}\frac{q_s}{\rho} = \frac{\phi C\mu}{k}\frac{\partial p}{\partial t}; \quad (5)$$

Where, k is the rock permeability, in m$^2$; $\phi$ is the rock porosity, in %.

It should be noted that in addition to the fracture propagation simulation method of the above embodiments, other simulation methods from the prior art can also be used for simulation.

Step 2: Using the test system to determine a maximum proppant particle size for entering the fracture at all width levels by the following equation according to statistical results of the width distribution of the fracture:

$$d_{max}=w/7 \quad (6);$$

where, $d_{max}$ is the maximum proppant particle size for entering the fracture, in m; if the minimum width of the fracture at a certain width level is 0 m, w is the median width of the fracture at that width level or the width of the fracture with the highest ratio; if the minimum width of the fracture at a certain width level is not 0 m, w is the minimum width of the fracture.

Step 3: Using the test system to determine a multi-size combination of proppants according to the Particle Size vs Mesh of Common Proppants, and determining an initial ratio of the proppant with each particle size based on the ratio of each fracture width; when determining the initial ratio of proppant with each particle size, the proppant of the maximum particle size is selected to enter the fracture at a certain width level if proppants of multiple particle sizes can enter the fracture.

Step 4: Using the test system to conduct a numerical simulation of proppant transportation in the fracture to determine a retention ratio of the proppants with each particle size.

Step 5: Using the test system to correct the initial ratio of the proppants with each particle size by the following equation according to the retention ratio and obtain a final ratio of the proppants with each particle size:

$$n_c=n(1+\alpha) \quad (7);$$

where, $n_c$ is the corrected ratio of proppant, dimensionless; n is the initial ratio of proppant, dimensionless; $\alpha$ is the retention ratio of proppant, dimensionless.

Then, obtain a final ratio of the proppants with each particle size by removing the proppants with greater particle size after the sum of the ratios is over 100% based on a criterion of satisfying the ratios of proppants with smaller particle sizes in priority.

Step 6: Using the test system to calculate an amount of the proppants with each particle size according to the final ratio and a sand pumping intensity and a fracturing interval length of the target reservoir, and using a display screen of the test system to display results of the amount of the proppants with each particle size and the propagation pattern of the fracture.

Figure 3:
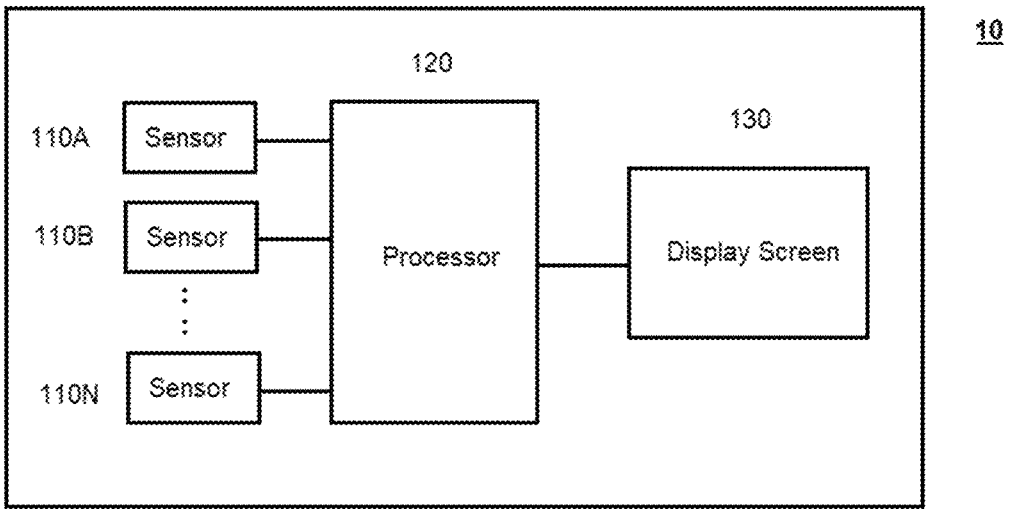
FIG. 3 is a block diagram of a test system for determining sand pumping parameters based on a width distribution of a fracture according to an embodiment of the present invention.

Please refer to FIG. 3. FIG. 3 is a block diagram of a test system for determining sand pumping parameters based on a width distribution of a fracture according to an embodiment of the present invention. The test system 10 includes a plurality of sensors 110A-110N, a processor 120, and a display screen 130.

The plurality of sensors 110A-110N are configured to acquire basic parameters of a target reservoir. The processor 120 is configured to: simulate a propagation of the fracture, and obtain a propagation pattern and the width distribution of the fracture; determine a maximum proppant particle size for entering the fracture at all width levels according to statistical results of the width distribution of the fracture; determine a multi-size combination of proppants according to a mapping table for particle size vs mesh of the proppants, and determine an initial ratio of the proppants with each particle size based on a ratio of each fracture width; conduct a numerical simulation of proppant transportation in the fracture to determine a retention ratio of the proppants with each particle size; correct the initial ratio of the proppants with each particle size according to the retention ratio and obtaining a final ratio of the proppants with each particle size; and calculate an amount of the proppants with each particle size according to the final ratio and a sand pumping intensity and a fracturing interval length of the target reservoir. The display screen 130 is configured to display results of the amount of the proppants with each particle size and the propagation pattern of the fracture.

Taking a fractured reservoir as an example, in the staged and clustered volume stimulation of horizontal wells in the reservoir, the method for determining sand pumping parameters based on a width distribution of a fracture includes the following steps:

(1) Using sensors to acquire basic parameters of a target reservoir; the results are shown in Table 1:

TABLE 1

Geological Engineering Parameters of Staged Multi-cluster Fracturing in Fractured Reservoirs

| Parameters | Values |
|---|---|
| Maximum horizontal principal stress, MPa | 70 |
| Minimum horizontal principal stress, MPa | 60 |
| Formation porosity, % | 5 |
| Wellbore azimuth, ° | 0 |
| Length of fracturing interval, m | 80 |
| Average length of natural fractures, m | 20 |
| Static Young's modulus, MPa | 22000 |
| Construction displacement, $m^3$/min | 14 |
| Sand pumping intensity, $m^3$/m | 1.5 |
| Formation pressure coefficient | 1.5 |
| Formation permeability, $10^{-3}$ $\mu m^2$ | 0.3 |
| Azimuth of maximum horizontal principal stress, ° | 90 |
| Number of clusters | 5 |
| Cluster spacing, m | 15 |
| Number of natural fractures | 200 |
| Azimuth of natural fracture | 60, 120 |
| Static Poisson's ratio | 0.22 |
| Liquid intensity, $m^3$/m | 25 |

(2) Establish a geologic model for reservoir fracturing as shown in FIG. 1 based on the reservoir geological parameters in Table 1.

Figure 2:
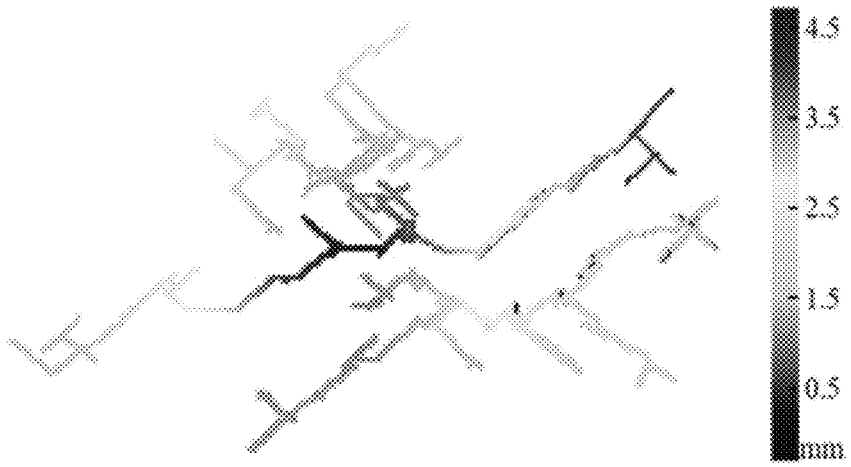
FIG. 2 is a schematic diagram of results of a propagation pattern of a complex fracture according to an embodiment of the present invention.

(3) On the basis of the geologic model for reservoir fracturing, utilize the damage-field-evolution-based fracture propagation model to simulate the fracture propagation pattern with the engineering parameters described in Table 1, and make statistics of the width distribution of fractures at various scales. The results are shown in FIG. 2 and Table 2.

TABLE 2

Statistical Results of Width Distribution of Fractures at Various Scales

| Fracture width, mm | 0-1.5 | 1.5-2.5 | 2.5-3.5 | 3.5-4.5 | 4.5-4.7 |
|---|---|---|---|---|---|
| Ratio | 0.05 | 0.1 | 0.4 | 0.35 | 0.1 |

(4) According to the statistical results of fracture width distribution in Table 2, work out the maximum proppant particle size for entering fractures at all width levels in combination with the Equation (6). The results are shown in Table 3.

TABLE 3

Maximum proppant particle size for Entering Fractures at All Width Levels

| Fracture width, mm | 0-1.5 | 1.5-2.5 | 2.5-3.5 | 3.5-4.5 | 4.5-4.7 |
|---|---|---|---|---|---|
| Maximum particle size, mm | 0.16 | 0.21 | 0.36 | 0.50 | 0.64 |

In Table 3, when calculating the maximum proppant particle size for entering fractures at a width level of 0 to 1.5, firstly make statistics of the width of fractures at that width level with the highest ratio, and then calculate the fracture width as w in the Equation (6); when calculating the maximum proppant particle size for entering fractures at other width levels, w in the Equation (6) is regarded as the minimum width of fractures at all width levels.

(5) Using the test system to determine a multi-size combination of proppants with reference to Table 4 Particle Size vs Mesh of Common Proppants and based on the principle of selecting the proppant of the maximum particle size to enter the fracture at a certain width level when proppants of multiple particle sizes can enter the fracture, and determining an initial ratio of the proppant with each particle size in combination with fracture width. The results are shown in Table 5.

TABLE 4

Particle Size vs Mesh of Common Proppants

| Proppant mesh | 20-40 | 30-50 | 40-70 | 70-140 | 100-200 |
|---|---|---|---|---|---|
| Particle size range, mm | 0.84-0.42 | 0.59-0.297 | 0.42-0.2 | 0.2-0.104 | 0.15-0.074 |

TABLE 5

Multi-size Combinations and Initial Ratios of Proppants

| Fracture width, mm | 0-1.5 | 1.5-2.5 | 2.5-3.5 | 3.5-4.5 | 4.5-4.7 |
|---|---|---|---|---|---|
| Proppant mesh | 100-200 | 70-140 | | 40-70 | 30-50 |
| Initial ratio, % | 5 | 50 | | 35 | 10 |

(6) Conduct numerical simulation of the transport of proppants with different particle sizes with the assistance of software to determine the retention ratios of proppants of different particle sizes. The results are shown in Table 6.

TABLE 6

| Retention Ratios of Proppants with Different Particle Sizes | | | | |
|---|---|---|---|---|
| Proppant mesh | 100-200 | 70-140 | 40-70 | 30-50 |
| Retention ratio α, % | 30 | 40 | 50 | 60 |

(7) According to the retention ratio results of proppants of different particle sizes in Table 6, Using the test system to correct the initial ratio of the proppants with each particle size in combination with the Equation (7), and obtain a final ratio of the proppants with each particle size by removing the proppants with greater particle size after the sum of the ratios is over 100% based on a criterion of satisfying the ratios of proppants with smaller particle sizes in priority. The results are shown in Table 7.

TABLE 7

| Final Ratio of Proppant with each particle size | | | | |
|---|---|---|---|---|
| Proppant mesh | 100-200 | 70-140 | 40-70 | 30-50 |
| Corrected ratio, % | 6.5 | 70 | 52.5 | 16 |
| Final ratio, % | 6.5 | 70 | 23.5 | 0 |

(8) Using the test system to calculate an amount of the proppants with each particle size according to the final ratio and the sand pumping intensity and fracturing interval length of the target reservoir (the amount of proppant of a certain particle size=sand pumping intensity*fracturing interval length*the final ratio of proppant of that particle size).

The results of the amount of the proppants with each particle size and the propagation pattern of the fracture are displayed on the display screen of the test system.

The amount of proppant with each particle size, which is calculated according to the present invention, has been applied to actual hydraulic fracturing, and achieved excellent engineering effect. Moreover, compared with the prior art, the present invention is advantaged by significantly improved fracturing performance, less calculation, no experiments required such as flow conductivity test, and much less cost.

The above are not intended to limit the present invention in any form. Although the present invention has been disclosed as above with embodiments, it is not intended to limit the present invention. Those skilled in the art, within the scope of the technical solution of the present invention, can use the disclosed technical content to make a few changes or modify the equivalent embodiment with equivalent changes. Within the scope of the technical solution of the present invention, any simple modification, equivalent change and modification made to the above embodiments according to the technical essence of the present invention are still regarded as a part of the technical solution of the present invention.

What is claimed is:

1. A method for determining sand pumping parameters based on a width distribution of a fracture, comprising the following steps:

Step 1: using a plurality of sensors to acquire basic parameters of a target reservoir, using a test system to simulate a propagation of the fracture, and using the test system to obtain a propagation pattern and the width distribution of the fracture;

Step 2: using the test system to determine a maximum proppant particle size for entering the fracture at all width levels according to statistical results of the width distribution of the fracture;

Step 3: using the test system to determine a multi-size combination of proppants according to a mapping table for particle size vs mesh of the proppants, and determining an initial ratio of the proppants with each particle size based on a ratio of each fracture width;

Step 4: using the test system to conduct a numerical simulation of proppant transportation in the fracture to determine a retention ratio of the proppants with each particle size;

Step 5: using the test system to correct the initial ratio of the proppants with each particle size according to the retention ratio and obtaining a final ratio of the proppants with each particle size; and Step 6: using the test system to calculate an amount of the proppants with each particle size according to the final ratio and a sand pumping intensity and a fracturing interval length of the target reservoir, and using a display screen of the test system to display results of the amount of the proppants with each particle size and the propagation pattern of the fracture;

wherein in the Step 1, a damage-field-evolution-based fracture propagation model is used to simulate the propagation of the fracture;

wherein the damage-field-evolution-based fracture propagation model comprises:

1) evolution equations of fracture damage field:

$$\eta\frac{\partial\varphi}{\partial t} = [2(1-\varphi)(\lambda S(\varepsilon_x+\varepsilon_y)/2 + GS(\varepsilon_x) + GS(\varepsilon_y)) - g_f\varphi/l + g_f l\Delta\varphi] \tag{1}$$

$$\varphi(d) = e^{\frac{-|d|}{l}}$$

$$S(d) = (|d|+d)^2/4;$$

where, η is a damping coefficient, in MPa·s; φ is a damage field function, dimensionless; t is a time, in s; λ is a Lamé first coefficient, in Pa; S is a ramp function, dimensionless; $\varepsilon_i$ is a principal strain in an i direction (i=x,y; x,y is a direction of the particle displacement), dimensionless; G is a Lamé second coefficient, in Pa; $g_f$ is a fracture toughness, in Pa; l is a length measurement parameter, dimensionless; Δφ is a variation of damage field, dimensionless; d is a formal parameter, dimensionless;

2) matrix stress field equations:

$$\rho\frac{\partial^2 u_i}{\partial t^2} = Gu_{i,jj} + \frac{G}{1-2\upsilon}u_{j,ji} + \eta\nabla^2 v_i \tag{2}$$

$$u_{i,jj} = \frac{\partial^2 u_i}{x^2} + \frac{\partial^2 u_i}{y^2} \quad i = x, y$$

$$u_{j,ji} = \frac{\partial^2 u_x}{\partial x\partial x} + \frac{\partial^2 u_y}{\partial y\partial x};$$

$$\sigma = \frac{2G\upsilon}{1-2\upsilon}(u_{i,i}+u_{j,j}) + G(u_{i,j}+u_{j,i}) \tag{3}$$

$$u_{i,i} = \frac{\partial u_i}{\partial i};\ u_{j,j} = \frac{\partial u_j}{\partial j};\ u_{i,j} = \frac{\partial u_i}{\partial j};\ u_{j,i} = \frac{\partial u_j}{\partial i}$$

$$i = x, y \quad j = x, y;$$

where, ρ is the density of the rock mass, in kg/m$^3$; $u_i$ is the displacement component, in m; $u_{i,jj}$, $u_{j,ji}$, $u_{i,i}$, $u_{j,j}$, $u_{i,j}$ and $u_{j,i}$ are the tensorial form of displacement increments, with j meaning a j direction (j=x, y, z), dimensionless; ν is the Poisson's ratio of the rock, dimensionless; ∇ is the Hamiltonian operator, dimensionless; $v_i$ is the velocity of the particle in the i direction, in m/s; σ is the stress of the particle, in Pa;

3) fracture flow equation:

$$\frac{w^3}{12\mu L}\frac{\partial^2 p}{\partial x^2}+\frac{w^3}{12\mu L}\frac{\partial^2 p}{\partial y^2}+\frac{q_s}{\rho}=\frac{wC}{L}\frac{\partial p}{\partial t}; \quad (4)$$

where, w is the fracture width, in m; μ is a fluid viscosity, in Pa·s; L is an unit length, in m; p is a fluid pressure, in Pa; $q_s$ is a grid source, in kg/(m$^3$·s); C is a rock compressibility, in Pa$^{-1}$;

4) matrix flow equation:

$$\frac{\partial^2 p}{\partial x^2}+\frac{\partial^2 p}{\partial y^2}+\frac{\mu}{k}\frac{q_s}{\rho}=\frac{\phi C\mu}{k}\frac{\partial p}{\partial t}; \quad (5)$$

where, κ is the rock permeability, in m$^2$; ϕ is a rock porosity, in %.

2. The method for determining sand pumping parameters based on a width distribution of a fracture according to claim 1, wherein the basic parameters comprise geological parameters and engineering parameters; the geological parameters comprise a crustal stress, a natural fracture distribution, and rock mechanics parameters; the engineering parameters comprise perforation parameters, a single-stage sand pumping intensity, and a construction displacement.

3. The method for determining sand pumping parameters based on a width distribution of a fracture according to claim 1, wherein in the Step 2, the maximum proppant particle size for entering the fracture at all width levels is determined by the following equation:

$$d_{max}=w/7 \quad (6);$$

where, $d_{max}$ is the maximum proppant particle size for entering the fracture, in m; if the minimum width of the fracture at a certain width level is 0 m, w is a median width of the fracture at that width level or the width of the fracture with a highest ratio; if the minimum width of the fracture at a certain width level is not 0 m, w is the minimum width of the fracture.

4. The method for determining sand pumping parameters based on a width distribution of a fracture according to claim 1, wherein in the Step 3, when determining the initial ratio of proppant with each particle size, the proppant with the maximum particle size is selected to enter the fracture at a certain width level if the proppants with multiple particle sizes are allowed to enter the fracture.

5. The method for determining sand pumping parameters based on a width distribution of a fracture according to claim 1, wherein in Step 5, the following equation is used to correct the initial ratio of the proppants with each particle size:

$$n_c=n(1+\alpha) \quad (7);$$

where, $n_c$ is a corrected ratio of the proppants, dimensionless; n is the initial ratio of the proppants, dimensionless; a is the retention ratio of the proppants, dimensionless;

using the test system to obtain the final ratio of proppant of each particle size by removing the proppants with a greater particle size after a sum of the ratios is over 100% based on a criterion of satisfying the ratios of the proppants with a smaller particle size in priority.

* * * * *